US010478843B2

(12) United States Patent
Yau et al.

(10) Patent No.: US 10,478,843 B2
(45) Date of Patent: Nov. 19, 2019

(54) LIQUID HAND WASH CONTAINER

(71) Applicant: Kam King Yau, Hong Kong (CN)

(72) Inventors: Kam King Yau, Hong Kong (CN); Huoxian Xie, Hong Kong (CN)

(73) Assignee: Huoxian Xie, Shenzhen, Guangdong (CN)

( * ) Notice: Subject to any disclaimer, the term of this patent is extended or adjusted under 35 U.S.C. 154(b) by 0 days.

(21) Appl. No.: 15/742,513

(22) PCT Filed: Jul. 7, 2016

(86) PCT No.: PCT/CN2016/089242
§ 371 (c)(1),
(2) Date: Jan. 7, 2018

(87) PCT Pub. No.: WO2017/005210
PCT Pub. Date: Jan. 12, 2017

(65) Prior Publication Data

US 2018/0193859 A1 Jul. 12, 2018

(30) Foreign Application Priority Data

Jul. 7, 2015 (CN) ..... 2015 1 0394195

(51) Int. Cl.
*B05B 11/00* (2006.01)
*A47K 5/12* (2006.01)

(52) U.S. Cl.
CPC ..... *B05B 11/3014* (2013.01); *A47K 5/1207* (2013.01); *B05B 11/3057* (2013.01)

(58) Field of Classification Search
CPC ..... B05B 11/3014; A47K 5/1207
See application file for complete search history.

(56) References Cited

U.S. PATENT DOCUMENTS 5,489,044 A * 2/1996 Ophardt ..... A47K 5/1205 222/1
8,905,265 B2 * 12/2014 Muderlak ..... A47K 5/1207 222/38
2018/0289222 A1 * 10/2018 Nilsson ..... A47K 5/1209

FOREIGN PATENT DOCUMENTS

CN 102046298 A 5/2011
CN 203987792 U 12/2014
CN 204931518 U 1/2016
CN 105662224 A 6/2016
DE 20012296 U1 11/2000

* cited by examiner

*Primary Examiner* — J C Jacyna

(57) ABSTRACT

A liquid hand wash container includes an outer casing, a rear casing, a liquid storage bottle, a liquid discharging pump module, a pressing plate, a pressing base, two thrust arc plates and a compression rod module, wherein the outer housing and the rear housing are connected with each other to form an accommodating cavity through a buckle; all of the liquid storage bottle, the liquid discharging pump module, the pressing base (6) and the compression rod module (8) are disposed within the accommodating cavity; all of the liquid storage bottle (3), the liquid discharging pump module and the compression rod module are fixedly disposed on the rear housing; an upper portion of a liquid discharging pump is connected with the liquid storage bottle through a liquid discharging tube, a lower portion of the liquid discharging pump is movably connected with the pressing base.

6 Claims, 3 Drawing Sheets

LIQUID HAND WASH CONTAINER

CROSS REFERENCE OF RELATED APPLICATION

This is a U.S. National Stage under 35 U.S.C 371 of the International Application PCT/CN2016/089242, filed Jul. 7, 2016, which claims priority under 35 U.S.C. 119(a-d) to CN 201510394195.7, filed Jul. 7, 2015.

BACKGROUND OF THE PRESENT INVENTION

Field of Invention

The present invention relates to a disinfecting and cleaning device, and more particularly to a liquid hand wash container.

Description of Related Arts

With the increase of living standards, people pay more and more attention to sanitation supplies. Now, disinfectant and liquid hand wash have been widely used in toilets and other places. Generally, the disinfectant and the liquid hand wash are firstly bottled and then installed into a liquid discharging container, and the liquid is discharged through manually pressing the pressing plate. However, the liquid is commonly discharged in existing liquid hand wash containers through pressing the pressing plate with springs, which requires people to use greater power during operation, and is long in press stroke, inconvenient to operate, difficult for people with disabilities to use, easy to be damaged and high in cost.

SUMMARY OF THE PRESENT INVENTION

An object of the present invention is to provide a liquid hand wash container which is small in press force and easy to be operated, so as to solve technical problems of existing press-type liquid hand wash container such as inconvenient operation, large press force and long press stroke. Specific technical solutions of the present invention are as follows.

A liquid hand wash container comprises an outer casing, a rear casing, a liquid storage bottle, a liquid discharging pump module, a pressing plate, a pressing base, two thrust arc plates and a compression rod module, wherein the outer housing and the rear housing are connected with each other to form an accommodating cavity through a buckle; all of the liquid storage bottle, the liquid discharging pump module, the pressing base and the compression rod module are disposed within the accommodating cavity; all of the liquid storage bottle, the liquid discharging pump module and the compression rod module are fixedly disposed on the rear housing; an upper portion of a liquid discharging pump is connected with the liquid storage bottle through a liquid discharging tube, a lower portion of the liquid discharging pump is movably connected with the pressing base; a bottom of the outer casing has an opening, the pressing plate is correspondingly disposed at the opening and is movably connected with the outer casing; one end of each of the thrust arc plates is fixedly connected with the pressing plate, the other end of each of the thrust arc plates is a concave arc-shaped end which presses against the compression rod module; the compression rod module is disposed below the pressing base and presses against a bottom of the pressing base.

Further, the compression rod module comprises two compression rods, a compression rod column, a compression rod rotary shaft and a compression rod fixed frame, wherein the compression rod fixed frame is fixedly connected with the rear casing; one end of each of the compression rods is fixedly connected with a side wall of the compression rod column, the other end of each of the compression rods is movably connected with the compression rod fixed frame through the compression rod rotary shaft; the compression rod column and the compression rods are at a same plane and perpendicular to each other, the compression rod column is parallel to the compression rod rotary shaft, the side wall of the compression rod column presses against the concave arc-shaped end of each of the thrust arc plates.

Further, the two compression rods are symmetrically disposed; a first compression rod, namely, one of the two compression rods is fixedly connected with a side wall at one end of the compression rod column; a second compression rod, namely, the other of the two compression rods is fixedly connected with a side wall at the other end of the compression rod column; the compression rod column, the compression rod rotary shaft and the two compression rods are connected with each other to form a quadrilateral component.

Further, the bottom of the pressing base has a liquid outlet which is connected with a liquid discharging nozzle; an outer diameter of the liquid discharging nozzle is smaller than an outer diameter of the pressing base; the liquid discharging nozzle passes through the quadrilateral component from top to down; the quadrilateral component is disposed at a joint of the pressing base and the liquid discharging nozzle, a whole side wall of the compression rod column presses against the bottom of the pressing base.

Further, the two thrust arc plates are symmetrically disposed; a first thrust arc plate is corresponding to the first compression rod; one end of the compression rod column is disposed between the first thrust arc plate and the first compression rod; a second thrust arc plate is corresponding to the second compression rod, the other end of the compression rod column is disposed between the second thrust arc plate and the second compression rod.

Further, when the pressing plate is pressed by an external force, the compression rod column slides at a concave arc-shaped end surface of each of the thrust arc plates, so as to drive the pressing base to move upwardly, the pressing base is disposed between the two thrust arc plates.

Further, the outer casing has a window which is corresponding to a bottom of the liquid storage bottle, and the liquid storage bottle is made of transparent materials.

Further, the pressing plate is connected with the outer casing through a revolving shaft.

Further, the liquid discharging pump module comprises a liquid discharging pump housing, and the liquid discharging pump is disposed within the liquid discharging pump housing which is fixedly disposed on the rear casing.

Further, the pressing plate and the thrust arc plates are integrally formed.

Compared with the prior art, the liquid hand wash container provided by the present invention has main beneficially effects as follows. Each of the thrust arc plates of the present invention has a concave arc-shaped end which presses against the compression rod module to drive the compression rod module to move, so as to further drive the pressing base to move upwardly; the liquid discharging nozzle is connected with the pressing base for discharging the liquid; a geometric shape of each of the thrust arc plates is based on the vector analysis of the thrust arc plates on the compression rod module during the entire press process, so that the entire press process is short in formation and small in press force. Moreover, the present invention is reliable in structure and low in manufacturing cost.

DETAILED DESCRIPTION OF THE PREFERRED EMBODIMENT

In order to make the objectives, technical solutions and advantages of the present invention more comprehensible, the present invention is further described in detail below with reference to the accompanying drawings and embodiments. It should be understood that the specific embodiments described herein are only used to explain the present invention, and are not intended to limit the present invention.

Embodiment

Figure 1:
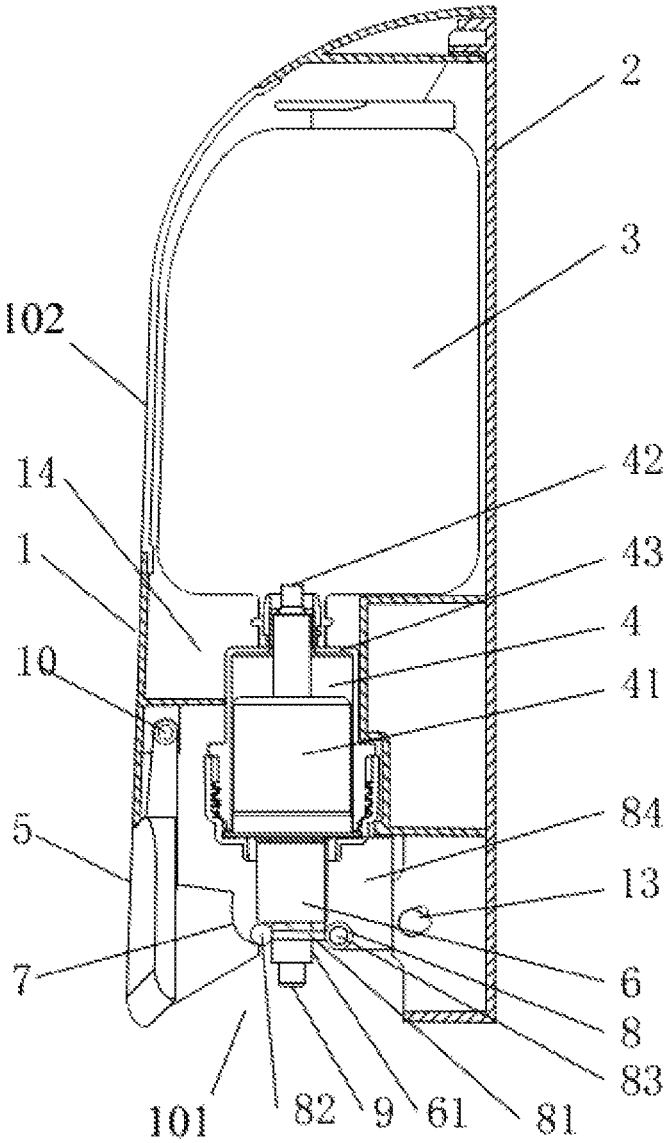
FIG. 1 is a structurally schematic view of a liquid hand wash container according to a preferred embodiment of the present invention.

Referring to FIG. 1, a liquid hand wash container is illustrated, which comprises an outer casing 1, a rear casing 2, a liquid storage bottle 3, a liquid discharging pump module 4, a pressing plate 5, a pressing base 6, two thrust arc plates 7 and a compression rod module 8, wherein the liquid discharging pump module 4 comprises a liquid discharging pump 41 and a liquid discharging tube 42; the outer casing 1 and the rear casing 2 are connected with each other to form an accommodating cavity 14 through a buckle 13; all of the liquid storage bottle 3, the liquid discharging pump module 4, the pressing base 6 and the compression rod module 8 are disposed within the accommodating cavity 14; all of the liquid storage bottle 3, the liquid discharging pump module 4 and the compression rod module 8 are fixedly disposed on the rear casing 2; an upper portion of the liquid discharging pump 41 is connected with the liquid storage bottle 3 through the liquid discharging tube 42, a lower portion of the liquid discharging pump 41 is movably connected with the pressing base 6; a bottom of the outer casing 1 has an opening 101, the pressing plate 5 is correspondingly disposed at the opening 101 and is movably connected with the outer casing 1 through a revolving shaft 10. One end of each of the thrust arc plates 7 is fixedly connected with the pressing plate 5. The pressing plate 5 and the thrust arc plates 7 are also able to be integrally formed. The other end of each of the thrust arc plates 7 is a concave arc-shaped end which presses against the compression rod module 8. The compression rod module 8 is disposed below the pressing base 6 and presses against a bottom of the pressing base 6.

Further, the compression rod module 8 comprises two compression rods 81, a compression rod column 82, a compression rod rotary shaft 83 and a compression rod fixed frame 84, wherein the compression rod fixed frame 84 is fixedly connected with the rear casing 2, one end of each of the compression rods 81 is fixedly connected with a side wall of the compression rod column 82, the other end of each of the compression rods 81 is movably connected with the compression rod fixed frame 84 through the compression rod rotary shaft 83, both the compression rod column 82 and the compression rods 81 are at a same plane and perpendicular to each other, the compression rod column 82 is parallel to the compression rod rotary shaft 83, the side wall of the compression rod column 82 presses against the concave arc-shaped end of each of the thrust arc plates 7.

The two compression rods 81 are symmetrically disposed; a first compression rod, namely, one of the two compression rods 81 is fixedly connected with a side wall at one end of the compression rod column 82; a second compression rod, namely, the other of the two compression rods 81 is fixedly connected with a side wall at the other end of the compression rod column 82; all of the compression rod column 82, the compression rod rotary shaft 83 and the two compression rods 81 are connected with each other to form a quadrilateral component.

The bottom of the pressing base 6 has a liquid outlet 61 which is connected with a liquid discharging nozzle 9. An outer diameter of the liquid discharging nozzle 9 is smaller than an outer diameter of the pressing base 6. The liquid discharging nozzle 9 passes through the quadrilateral component from top to down. The quadrilateral component is disposed at a joint of the pressing base 6 and the liquid discharging nozzle 9, the side wall of the compression rod column 82 presses against the bottom of the pressing base 6.

The two thrust arc plates 7 are symmetrically disposed. A first thrust arc plate, that is, one of the two thrust arc plates 7 is corresponding to the first compression rod, one end of the compression rod column 82 is disposed between the first thrust arc plate and the first compression rod; a second thrust arc plate, that is, the other of the two thrust arc plates 7 is corresponding to the second compression rod, the other end of the compression rod column 82 is disposed between the second thrust arc plate and the second compression rod.

Figure 2:
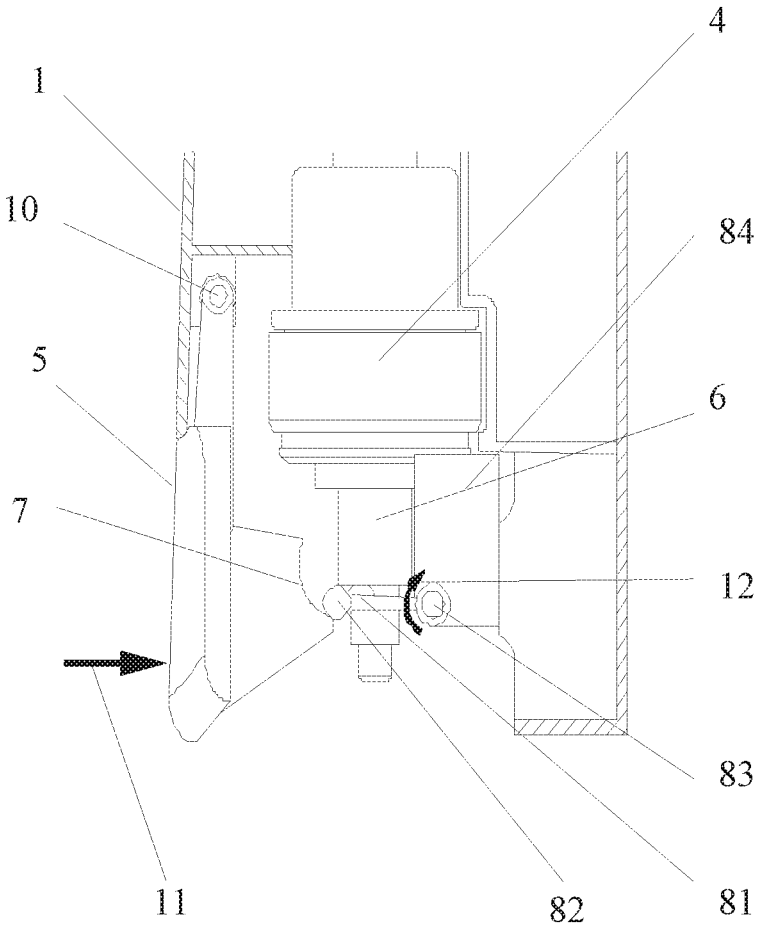
FIG. 2 is a working principle diagram of the liquid hand wash container according to the above preferred embodiment of the present invention.

It should be noted that, as shown in FIG. 2, when the pressing plate 5 is pressed by an external force along a direction of an arrow 11, the two thrust arc plates 7 drive the compression rod column 82 to move, so as to further drive the compression rods to move along a direction of an arrow 12; and then the compression rods 81 drive the pressing base 6 to move upwardly for further driving the liquid discharging pump 41, and finally liquid in the liquid storage bottle 3 flows out from the liquid discharging nozzle 9 which is disposed below the pressing base 6.

Figure 3:
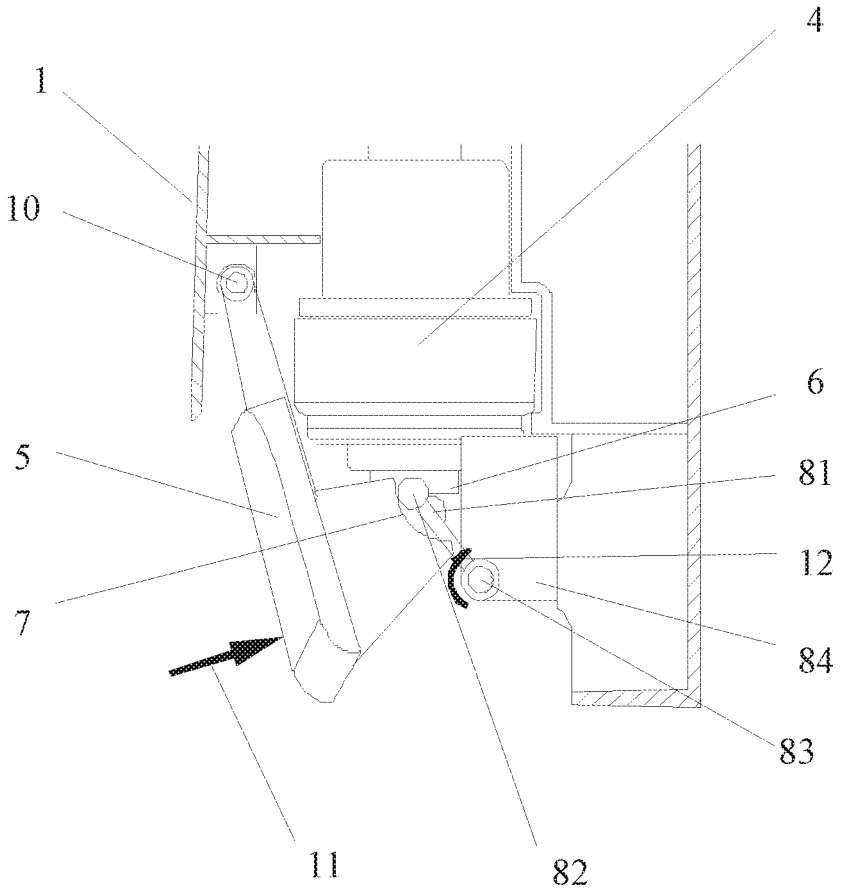
FIG. 3 is another working principle diagram of the liquid hand wash container according to the above preferred embodiment of the present invention.

Referring to FIG. 3, the compression rod column 82 slides at a concave arc-shaped end surface of each of the thrust arc plates 7, the thrust arc plates 7 drive the compression rod column 82 along the direction of the arrow 11 to an end position, the compression rods 81 drive the pressing base 6 to move upwardly, the pressing base 6 is disposed between the two thrust arc plates 7, so as to complete the press-type liquid discharging process.

Further, the outer casing 1 has a window 102 for observing a height of the liquid in the liquid storage bottle 3, which facilitates adding liquid hand wash. The window 102 is provided on a position of the outer casing 1 which is corresponding to a bottom of the liquid storage bottle 3. The liquid storage bottle 3 is made of transparent materials.

Further, the liquid discharging pump module 4 comprises a liquid discharging pump housing 43, and the liquid discharging pump 41 is disposed within the liquid discharging pump housing 43 which is fixedly disposed on the rear casing 2.

Through the vector analysis of the press pressure, the present invention provides the thrust arc plate structure;

under the action of the external force, the compression rods drive the thrust arc plates to move, the compression rod column moves along the concave arc-shaped end surface of the thrust arc plates, so as to achieve highly efficient and labor-saving press-type liquid discharging process.

It should be noted that the above embodiment is merely intended for describing the technical solutions of the present invention rather than to limit the present invention. Although the present invention is described in detail with reference to the preferred embodiment, it should be understood by those skilled in the art that any modification or equivalent substitution of the technical solutions without departing from the spirit and scope of the technical solutions of the present invention should be covered by the scope of the claims of the present invention.

What is claimed is:

1. A liquid hand wash container, comprising: an outer casing, a rear casing, a liquid storage bottle, a liquid discharging pump module, a pressing plate, a pressing base, two thrust arc plates and a compression rod module, wherein:

the liquid discharging pump module comprises a liquid discharging pump and a liquid discharging tube; the outer casing and the rear casing are connected with each other to form an accommodating cavity through a buckle; all of the liquid storage bottle, the liquid discharging pump module, the pressing base and the compression rod module are disposed within the accommodating cavity; all of the liquid storage bottle, the liquid discharging pump module and the compression rod module are fixedly disposed on the rear casing; an upper portion of the liquid discharging pump is connected with the liquid storage bottle through the liquid discharging tube, a lower portion of the liquid discharging pump is movably connected with the pressing base; a bottom of the outer casing has an opening, the pressing plate is correspondingly disposed at the opening and is movably connected with the outer casing; one end of each of the thrust arc plates is fixedly connected with the pressing plate, the other end of each of the thrust arc plates is a concave arc-shaped end which presses against the compression rod module; the compression rod module is disposed below the pressing base and presses against a bottom of the pressing base;

the compression rod module comprises two compression rods, a compression rod column, a compression rod rotary shaft and a compression rod fixed frame, wherein the compression rod fixed frame is fixedly connected with the rear casing; one end of each of the compression rods is fixedly connected with a side wall of the compression rod column, the other end of each of the compression rods is movably connected with the compression rod fixed frame through the compression rod rotary shaft; the compression rod column and the compression rods are at a same plane and perpendicular to each other, the compression rod column is parallel to the compression rod rotary shaft, the side wall of the compression rod column presses against the concave arc-shaped end of each of the thrust arc plates;

the two compression rods are symmetrically disposed; a first compression rod, namely, one of the two compression rods is fixedly connected with a side wall at one end of the compression rod column; a second compression rod, namely, the other of the two compression rods is fixedly connected with a side wall at the other end of the compression rod column; the compression rod column, the compression rod rotary shaft and the two compression rods are connected with each other to form a quadrilateral component;

the bottom of the pressing base has a liquid outlet which is connected with a liquid discharging nozzle; an outer diameter of the liquid discharging nozzle is smaller than an outer diameter of the pressing base; the liquid discharging nozzle passes through the quadrilateral component from top to down; the quadrilateral component is disposed at a joint of the pressing base and the liquid discharging nozzle, a whole side wall of the compression rod column presses against the bottom of the pressing base;

the two thrust arc plates are symmetrically disposed; a first thrust arc plate is corresponding to the first compression rod; one end of the compression rod column is disposed between the first thrust arc plate and the first compression rod; a second thrust arc plate is corresponding to the second compression rod, the other end of the compression rod column is disposed between the second thrust arc plate and the second compression rod.

2. The liquid hand wash container, as recited in claim 1, wherein when the pressing plate is pressed by an external force, the compression rod column slides at a concave arc-shaped end surface of each of the thrust arc plates, so as to drive the pressing base to move upwardly; the pressing base is disposed between the two thrust arc plates.

3. The liquid hand wash container, as recited in claim 2, wherein the outer casing has a window which is corresponding to a bottom of the liquid storage bottle, and the liquid storage bottle is made of transparent materials.

4. The liquid hand wash container, as recited in claim 3, wherein the pressing plate is connected with the outer casing through a revolving shaft.

5. The liquid hand wash container, as recited in claim 4, wherein the liquid discharging pump module comprises a liquid discharging pump housing, and the liquid discharging pump is disposed within the liquid discharging pump housing which is fixedly disposed on the rear casing.

6. The liquid hand wash container, as recited in claim 5, wherein the pressing plate and the thrust arc plates are integrally formed.

* * * * *